US010570548B2

(12) United States Patent
Lee et al.

(10) Patent No.: US 10,570,548 B2
(45) **Date of Patent: *Feb. 25, 2020**

(54) LAUNDRY TREATMENT APPARATUS

(71) Applicant: LG ELECTRONICS INC., Seoul (KR)

(72) Inventors: Jihong Lee, Seoul (KR); Hyeokjin Gwon, Seoul (KR); Hyojin Joo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/199,880

(22) Filed: Nov. 26, 2018

(65) Prior Publication Data

US 2019/0093274 A1 Mar. 28, 2019

Related U.S. Application Data

(62) Division of application No. 15/198,252, filed on Jun. 30, 2016, now Pat. No. 10,138,585.

(30) Foreign Application Priority Data

Jun. 30, 2015 (KR) ..... 10-2015-0092784

(51) Int. Cl.
*D06F 37/28* (2006.01)
*D06F 39/00* (2006.01)
(Continued)

(52) U.S. Cl.
CPC ..... *D06F 37/28* (2013.01); *D06F 37/02* (2013.01); *D06F 37/26* (2013.01); *D06F 39/005* (2013.01);
(Continued)

(58) Field of Classification Search
CPC ..... D06F 39/14; D06F 37/28; D06F 39/005; D06F 37/26; D06F 37/02; D06F 23/04; D06F 37/42; D06F 31/00
See application file for complete search history.

(56) References Cited

U.S. PATENT DOCUMENTS 5,742,964 A 4/1998 Choi
5,850,746 A 12/1998 Lee
(Continued)

FOREIGN PATENT DOCUMENTS

CN 1158923 9/1997
CN 1160100 9/1997
(Continued)

OTHER PUBLICATIONS

Canadian Office Action in Canadian Application No. 2,956,507, dated Mar. 13, 2018, 6 pages.
(Continued)

*Primary Examiner* — Michael E Barr
*Assistant Examiner* — Benjamin L Osterhout
(74) *Attorney, Agent, or Firm* — Fish & Richardson P.C.

(57) ABSTRACT

A laundry treatment apparatus includes a cabinet having an introduction/discharge opening, a drawer configured so as to be discharged from the cabinet through the introduction/discharge opening, a through-hole formed in an upper surface of the drawer, a tub that is located inside the drawer and that defines a space that is configured to receive water, an introduction aperture formed in an upper surface of the tub, the introduction aperture being located under the through-hole, a drum rotatably provided inside the tub for receiving laundry supplied to the introduction aperture, a door that is configured to open and close the introduction aperture, the door being coupled to one of the drawer or the tub, and a door sensing unit that is configured to determine whether the
(Continued)

door is opened during a state in which the drawer is inserted into the cabinet.

16 Claims, 6 Drawing Sheets

(51) Int. Cl.

| | |
|---|---|
| ***D06F 39/14*** | (2006.01) |
| ***D06F 37/26*** | (2006.01) |
| ***D06F 37/02*** | (2006.01) |
| ***D06F 31/00*** | (2006.01) |
| ***D06F 23/04*** | (2006.01) |
| ***D06F 37/42*** | (2006.01) |

(52) U.S. Cl.
CPC ..... *D06F 39/14* (2013.01); *D06F 23/04* (2013.01); *D06F 31/00* (2013.01); *D06F 37/42* (2013.01)

(56) References Cited

U.S. PATENT DOCUMENTS

| | | | |
|---|---|---|---|
| 8,627,527 | B2 | 1/2014 | Lee et al. |
| 2008/0256721 | A1 | 10/2008 | Kim et al. |
| 2009/0139276 | A1 | 6/2009 | Kim et al. |
| 2009/0145174 | A1 | 6/2009 | Kim et al. |
| 2009/0145175 | A1 | 6/2009 | Kim et al. |
| 2009/0145176 | A1 | 6/2009 | Kim et al. |
| 2009/0145177 | A1 | 6/2009 | Kim et al. |
| 2009/0288452 | A1 | 11/2009 | Lee et al. |
| 2010/0000024 | A1 | 1/2010 | Hendrickson et al. |
| 2010/0000265 | A1 | 1/2010 | Hendrickson et al. |
| 2010/0000573 | A1 | 1/2010 | Hendrickson et al. |
| 2010/0307200 | A1 | 12/2010 | Jeong et al. |
| 2011/0265524 | A1 | 11/2011 | Kim et al. |
| 2013/0047677 | A1 | 2/2013 | Han et al. |
| 2014/0096572 | A1 | 4/2014 | Kim et al. |
| 2014/0103788 | A1 | 4/2014 | Park |
| 2014/0196507 | A1 | 7/2014 | Lee et al. |
| 2014/0238087 | A1 | 8/2014 | Bae et al. |
| 2014/0238088 | A1 | 8/2014 | Bae et al. |
| 2015/0059418 | A1 | 3/2015 | Lee et al. |

FOREIGN PATENT DOCUMENTS

| | | |
|---|---|---|
| CN | 101302706 | 11/2008 |
| CN | 101617077 | 12/2009 |
| CN | 103205879 | 7/2013 |
| EP | 1205591 | 5/2002 |
| EP | 2002776 | 12/2008 |
| EP | 2063014 | 5/2009 |
| JP | 20002346290 | 12/2002 |
| JP | 2011518636 | 6/2011 |
| JP | 2013103109 | 5/2013 |
| KR | 1020020006807 | 1/2002 |
| TW | 377724 | 12/1999 |
| WO | W02009134070 | 11/2009 |

OTHER PUBLICATIONS

Chinese Office Action in Chinese Application No. 201610509517.2, dated Feb. 24, 2018, 17 pages.

Extended European Search Report issued in European Application No. 16176891.6, dated Nov. 2, 2016, 7 pages.

PCT International Search Report and Written Opinion in International Application No. PCT/KR2016/007024, dated Sep. 12, 2016, 14 pages.

Taiwanese Office Action in Taiwanese Application No. 105118993, dated Dec. 8, 2016, 13 pages.

Indian Office Action in Indian Application No. 201737002740, dated Oct. 23, 2019, 7 pages (with English translation).

【FIG 1】
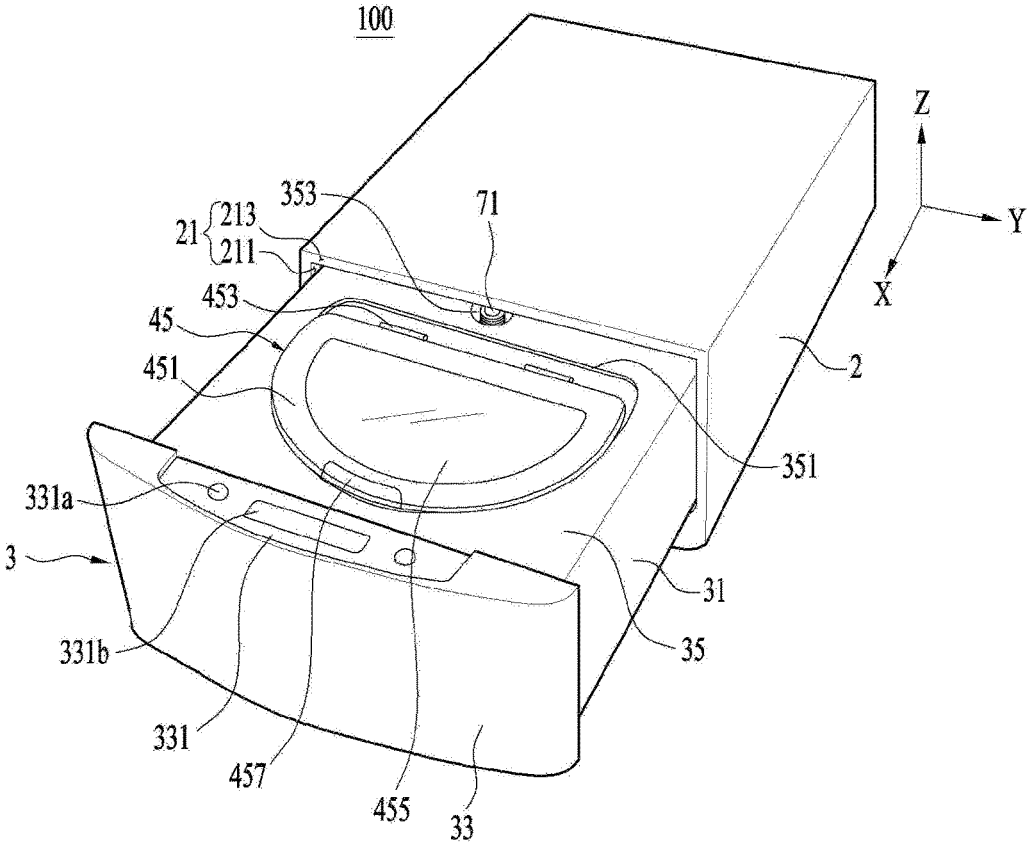

【 FIG 2】
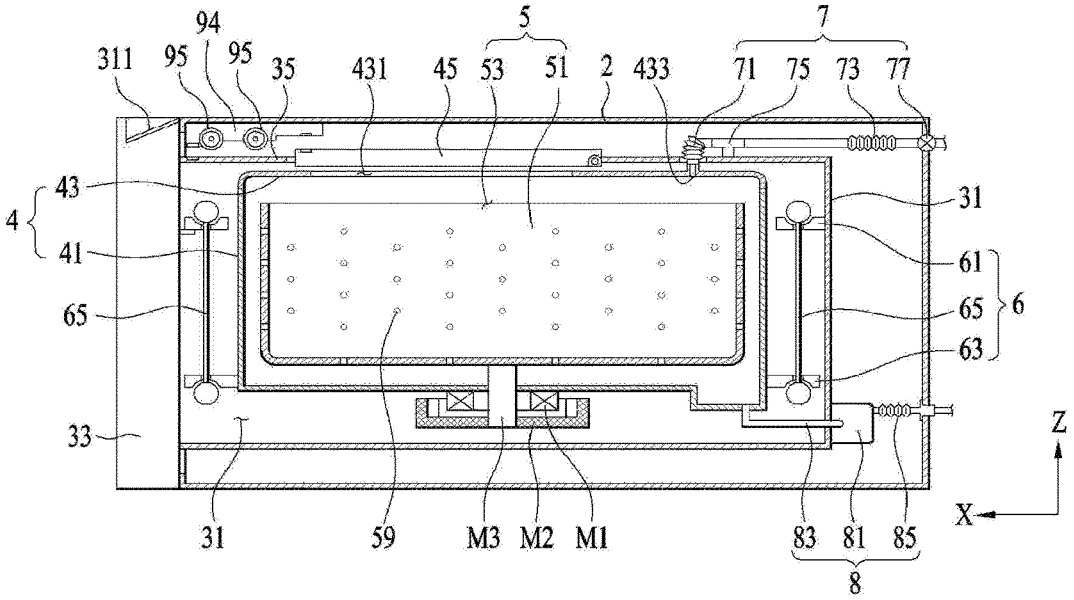

【 FIG 3】
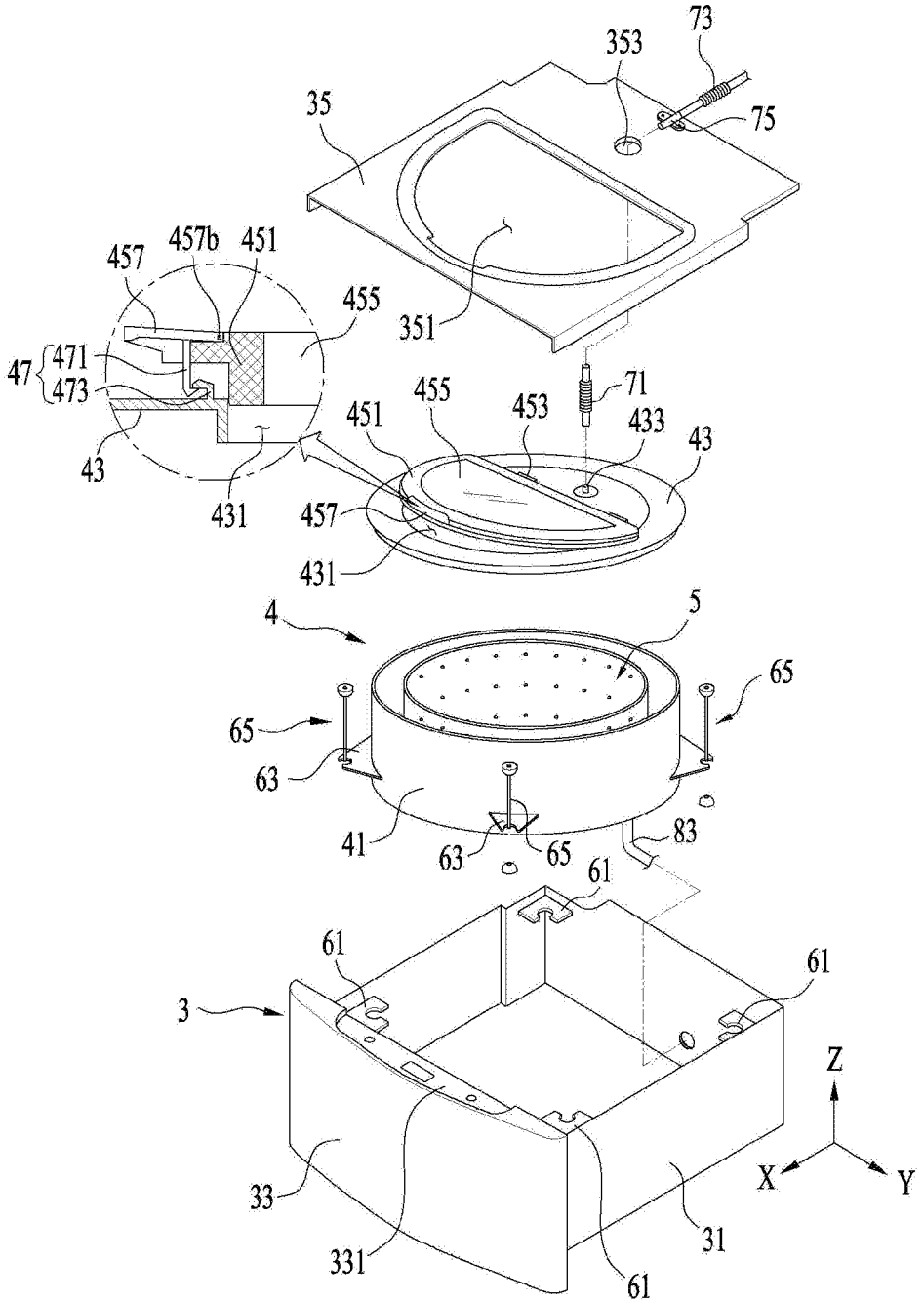

【 FIG 4】
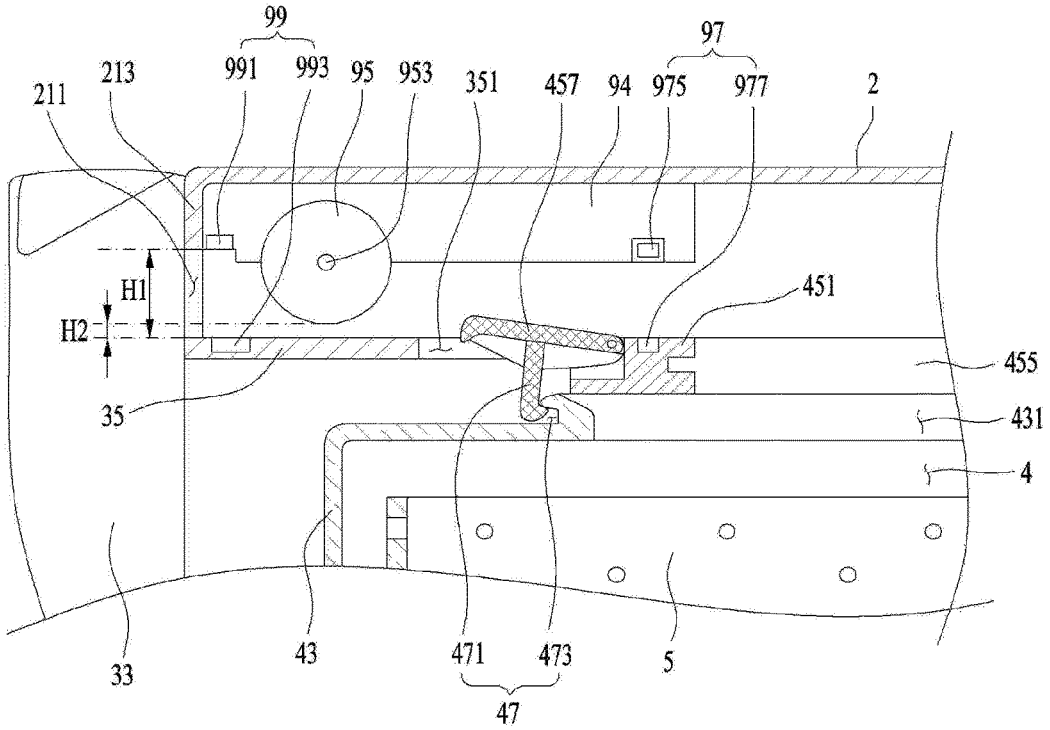

【 FIG 5】
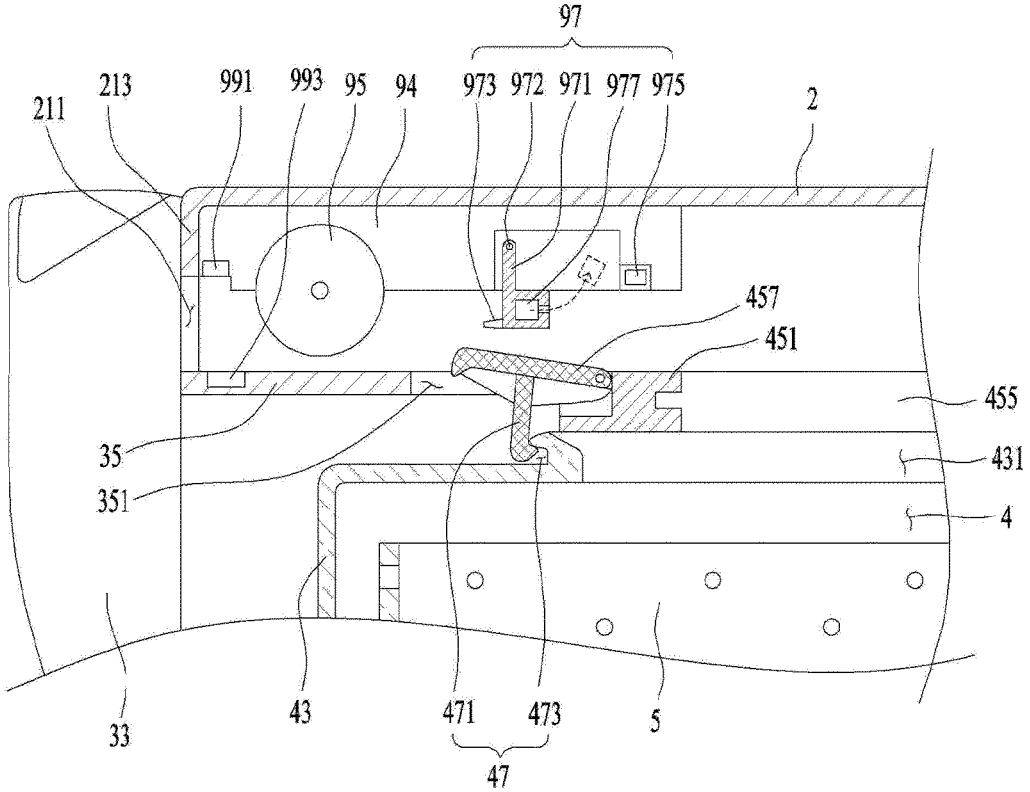

【 FIG 6】
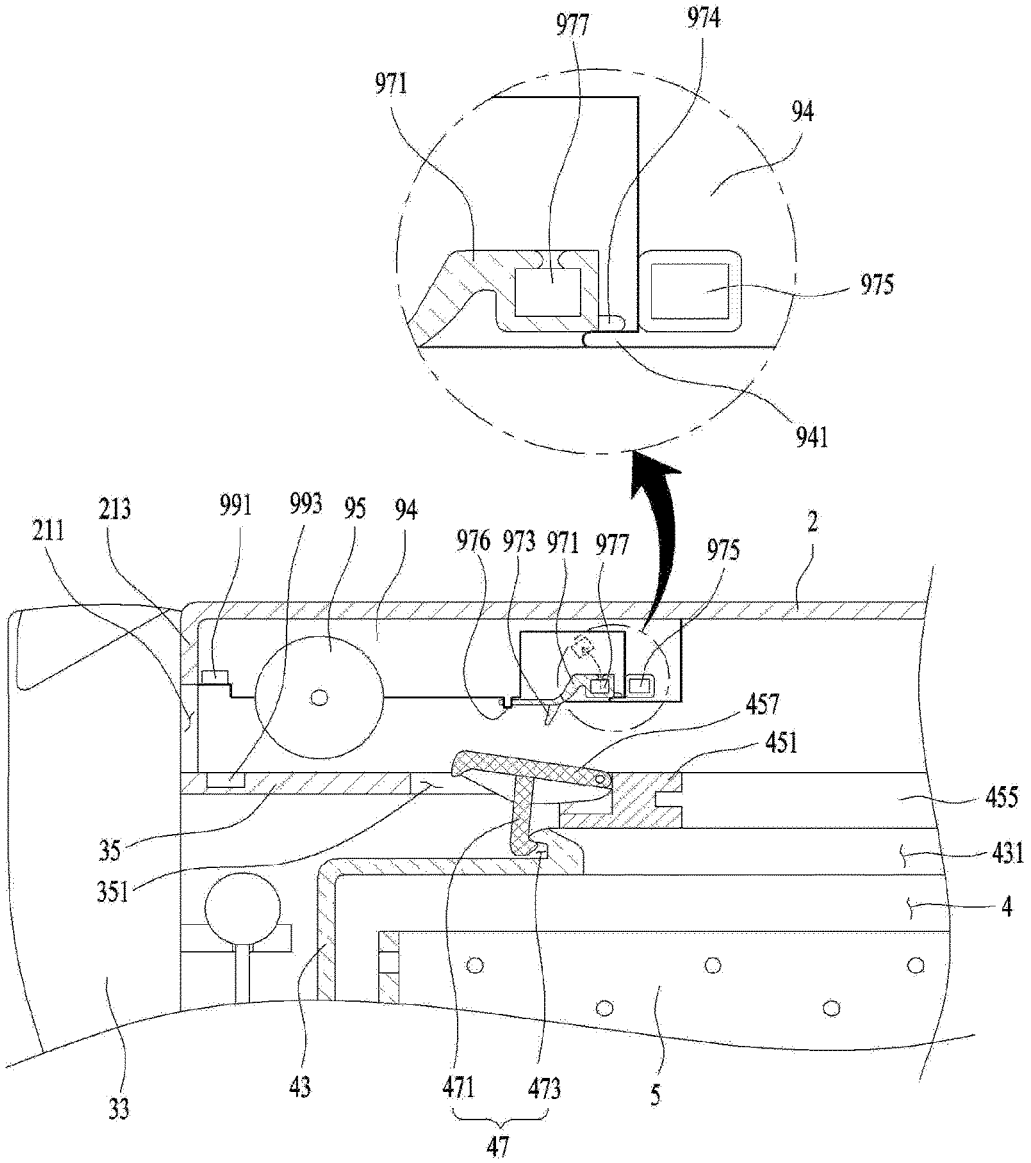

LAUNDRY TREATMENT APPARATUS

CROSS REFERENCE TO RELATED APPLICATION

This application is a divisional of U.S. application Ser. No. 15/198,252, filed on Jun. 30, 2016, which claims the benefit of Korean Patent Application No. 10-2015-0092784, filed on Jun. 30, 2015, which are hereby incorporated by reference as if fully set forth herein.

BACKGROUND

The present disclosure relates to a laundry treatment apparatus.

FIELD

Generally, a laundry treatment apparatus is a generic term for an apparatus that washes laundry (e.g. objects to be washed or objects to be dried), an apparatus that dries laundry, and an apparatus that may perform both washing and drying of laundry.

Conventional laundry treatment apparatuses are classified into front loading type laundry treatment apparatuses configured such that laundry is introduced through an introduction opening formed in the front surface of the apparatus, and top loading type laundry treatment apparatuses configured such that laundry is introduced through an introduction opening formed in the upper surface of the apparatus.

A top loading type laundry treatment apparatus may include a cabinet, a tub provided inside the cabinet and having an introduction opening in the upper surface thereof, a drum rotatably provided inside the tub, and a door for opening and closing the introduction opening.

SUMMARY

One object of the subject matter described in this application is to provide a laundry treatment apparatus, which may notify a user that a door to open an introduction aperture is opened in the state in which a drawer is inserted into a cabinet.

In addition, another object of the subject matter described in this application is to provide a laundry treatment apparatus, which may allow a drawer to be discharged from a cabinet even if a door to open an introduction aperture is opened in the state in which the drawer is inserted into the cabinet.

In addition, another object of the subject matter described in this application is to provide a laundry treatment apparatus, which may determine whether or not a drawer is inserted into a cabinet and may notify a user of the result of the determination.

In addition, another object of the subject matter described in this application is to provide a laundry treatment apparatus, which may prevent a door from being incorrectly determined to be opened due to, for example, external signals, such as vibration.

In addition, another object of the subject matter described in this application is to provide a laundry treatment apparatus, which may accurately sense, using magnetic force, whether or not a door to open an introduction opening has been opened.

In addition, a further object of the subject matter described in this application is to provide a laundry treatment apparatus, which may accurately determine the occurrence of abnormalities in constituent elements for determining whether or not a door to open an introduction opening is opened.

According to one aspect, a laundry treatment apparatus includes a cabinet having an introduction/discharge opening, a drawer configured so as to be discharged from the cabinet through the introduction/discharge opening, a through-hole formed in an upper surface of the drawer, a tub that is located inside the drawer and that defines a space that is configured to receive water, an introduction aperture formed in an upper surface of the tub, the introduction aperture being located under the through-hole, a drum rotatably provided inside the tub for receiving laundry supplied to the introduction aperture, a door that is configured to open and close the introduction aperture, the door being coupled to one of the drawer or the tub, and a door sensing unit that is configured to determine whether the door is opened during a state in which the drawer is inserted into the cabinet.

Implementations according to this aspect may include one or more of the following features. For example, the door sensing unit may include a first magnetic-force generator that is configured to generate magnetic force and that is located in one of the cabinet or the door, and a first magnetic-force sensor that is configured to sense a magnitude of the magnetic force generated by the first magnetic-force generator and that is located in the other of the cabinet and the door. In some cases, the door sensing unit may include a base that is located inside the cabinet and that is positioned vertically above the door, a first magnetic-force sensor that is located in the base and that is configured to sense magnetic force, a body rotatably that is located in the base and that is configured to be rotated toward the first magnetic-force sensor based on the door being opened, and a first magnetic-force generator that is coupled to the rotating body and that is configured to generate magnetic force. The laundry treatment apparatus may further include a notification unit that is configured to notify a user that the door is opened based on the magnetic force sensed by the first magnetic-force sensor being equal to or greater than a predetermined first reference magnetic force. The laundry treatment apparatus may further include a notification unit that is configured to notify a user that the door is opened based on the magnetic force measured by the first magnetic-force sensor being continuously equal to or greater than a predetermined first reference magnetic force for a predetermined reference time or more.

In some implementations, the door sensing unit may include a base that is located inside the cabinet and that is positioned vertically above the door, a first magnetic-force sensor that is located in the base and that is configured to sense magnetic force, a body rotatably that is located in the base and configured to be rotated away from the first magnetic-force sensor based on the door being opened, and a first magnetic-force generator that is coupled to the rotating body and that is configured to generate magnetic force. The laundry treatment apparatus may further include a display unit that is configured to notify a user that the door is opened based on the magnetic force sensed by the first magnetic-force sensor being below a predetermined first reference magnetic force. The display unit may be configured to notify a user that the door is opened based on the magnetic force sensed by the first magnetic-force sensor being continuously below the predetermined first reference magnetic force for a predetermined reference time or more. The display unit may be configured to display characters or symbols, configured to generate a sound, or configured to emit light. The display unit may include an LCD, a speaker, or a lamp. The laundry treatment apparatus may further include a body support portion that is located on the base and that is configured to prevent the body from being rotated toward the door. In some cases, the laundry treatment apparatus may further include a body contact portion that is located on the body and that is configured to come into contact with the door based on the door being opened.

In some cases, the laundry treatment apparatus may further include a drawer sensing unit that is configured to determine whether the drawer is inserted into the cabinet to a predetermined reference position. The drawer may include a drawer body that is located inside the cabinet and that defines a space for receiving the tub, and further may include a drawer panel that is configured to open and close the front opening of the cabinet. The drawer sensing unit may be configured to determine whether the front opening is closed by the drawer panel. The drawer sensing unit may include a second magnetic-force generator that is located in one of the cabinet or the drawer and that is configured to generate magnetic force, and a second magnetic-force sensor that is located in the other of the cabinet or the drawer and that is configured to sense the magnetic force generated by the second magnetic-force generator. The laundry treatment apparatus may further include a notification unit that is configured to notify a user that the front opening is in an open state based on the magnetic force sensed by the second magnetic-force sensor being below a predetermined second reference magnetic force. The laundry treatment apparatus may further include a display unit that is configured to notify a user that the door is opened based on the magnetic force sensed by the first magnetic-force sensor being equal to or greater than a predetermined first reference magnetic force. The laundry treatment apparatus may further include a display unit that is configured to notify a user that the door is opened based on the magnetic force measured by the first magnetic-force sensor being continuously equal to or greater than a predetermined first reference magnetic force for a predetermined reference time or more. The display unit may be configured to display characters or symbols, configured to generate a sound, or configured to emit light. In some cases, the display unit may include an LCD, a speaker, or a lamp.

BRIEF DESCRIPTION OF THE DRAWINGS

FIGS. 1 and 2 are views showing an example laundry treatment apparatus.

FIG. 3 is a view showing an example coupling structure of a drawer, a tub, and a drum.

FIGS. 4 to 6 are views showing an example of a door sensing unit and a drawer sensing unit.

DETAILED DESCRIPTION

As illustrated in FIGS. 1 and 2, a laundry treatment apparatus 100 may include a cabinet 2, a drawer 3 provided so as to be discharged from the cabinet 2, a tub 4 provided inside the drawer 3 for storing water therein, and a drum 5 rotatably provided inside the tub 4 for storing laundry therein.

The cabinet 2 may serve to define the external appearance of the laundry treatment apparatus 100, and may also simply serve as a space in which the drawer 3 is received. In any case, the cabinet 2 may be provided in the front surface thereof with an introduction/discharge opening 21 for the insertion of the drawer 3.

The introduction/discharge opening 21 may include an opening 211 formed in one surface of the cabinet 2, and a flange 213 provided along the edge of the opening 211.

The drawer 3 includes a drawer body 31 configured so as to be inserted into the cabinet 2 through the introduction/discharge opening 21, a drawer panel 33 fixed to the front surface of the drawer body 31 for opening and closing the opening 211, and a drawer cover 35 for forming the upper surface of the drawer body 31.

Because the drawer panel 33 is fixed to the front surface of the drawer body 31, the drawer panel 33 may serve as a handle for discharging the drawer body 31 from the cabinet 2.

Once the drawer panel 33 has moved to the position at which the opening 211 is closed by the drawer panel 33, the drawer panel 33 may come into contact with the flange 213. Accordingly, the flange 213 serves not only to arrange the drawer body 31 at a reference position, which is set inside the cabinet 2, but also to prevent the drawer panel 33 from being inserted into the cabinet 2.

The drawer panel 33 may be provided with a control panel 331, which is used to input a control command associated with the operation of the laundry treatment apparatus 100 and to notify a user of a message associated with the operation of the laundry treatment apparatus 100. The control panel 331 may include an input unit 331*a* for the input of a control command, and a display unit 331*b* for displaying signals associated with the operation of the laundry treatment apparatus 100 including the control command. The display unit 331*b* may be at least one selected from among a device for displaying characters or symbols (e.g. an LCD), a device for generating sound (e.g. a speaker), and a device for emitting light (e.g., a lamp).

The drawer body 31 may have any shape so long as it can be inserted into the cabinet 2 through the opening 211 and so long as it can provide a space in which the tub 4 is received. FIG. 1 illustrates the drawer body 31 having a hexahedral shape by way of example.

The drawer cover 35 has a first through-hole 351 and a second through-hole 353 for communicating the inside of the drawer body 31 with the outside. The first through-hole 351 must be provided for the introduction and discharge of laundry, and the second through-hole 353 must be provided to supply water required to wash the laundry. A detailed description related thereto will follow.

As illustrated in FIG. 2, the tub 4 includes a tub body 41 located inside the drawer body 31 for storing water therein, and a tub cover 43 for forming the upper surface of the tub body 41. The tub body 41 may take the form of a cylinder having an open upper surface.

The tub cover 43 may have an introduction aperture 431 for communicating the inside of the tub body 41 with the outside of the tub body 41, and a supply aperture 433 for introducing water into the tub body 41.

The introduction aperture 431 may be provided under the first through-hole 351 provided in the drawer cover 35, and the supply aperture 433 may be provided so as to communicate with the second through-hole 353 provided in the drawer cover 35.

The introduction aperture 431 serves to allow laundry to be introduced into the tub body 41, or to allow the laundry inside the tub body 41 to be discharged to the outside of the tub body 41. The introduction aperture 431 is opened and closed by a door 45, which is rotatably provided on any one of the drawer cover 35 or the tub cover 43.

FIG. 3 illustrates the case where the door 45 is coupled to the tub cover 43. In this case, the door 45 may include a frame 451 rotatably coupled to the tub cover 43 via a hinge 453, a window 455 provided in the frame 451, and a handle 457 for separably coupling the frame 451 to the tub cover 43.

The window 455 may be formed of a transparent material to allow the user to view the inside of the tub body 41 when the drawer 3 is discharged from the cabinet 2.

The handle 457 is rotatably coupled to the frame 451 via a handle shaft 457*b*, and the handle 457 is separably fixed to the tub cover 43 via a fixing unit 47.

The fixing unit 47 may include a first fastening portion 471 (e.g. a hook) protruding from any one of the handle 457 and the tub cover 43, and a second fastening portion 473 (e.g. a hook receiving recess) formed in the other one of the handle 457 and the tub cover 43 for separably receiving the first fastening portion 471.

The tub body 41 may be coupled to the drawer body 31 via a tub support unit 6. The tub support unit 6 may include a first support member 61 provided at the drawer body 31, a second support member 63 provided at the tub body 41, and a connector 65 for connecting the first support member 61 and the second support member 63 to each other.

The drum 5, which is provided inside the tub 4, may be provided in a form illustrated in FIG. 2. That is, the drum 5 may include a cylindrical drum body 51 having an opening 53 (e.g. a drum opening) formed in the upper surface thereof.

Because the drum opening 53 is located below the introduction aperture 431, the laundry supplied through the introduction aperture 431 may be supplied to the drum body 51 through the drum opening 53. A plurality of drum through-holes 59 may be provided in a bottom surface and a circumferential surface of the drum body 51 for communicating the inside of the drum body 51 with the tub body 41.

The drum body 51 may be rotated inside the tub body 41 by a drive unit. The drive unit may include a stator M1 located outside the tub body 41 and fixed to the bottom surface of the tub body 41, a rotor M2 configured so as to be rotated by a rotating magnetic field provided by the stator M1, and a rotating shaft M3 penetrating the bottom surface of the tub body 41 for connecting the bottom surface 57 of the drum 5 and the rotor M2 to each other. In this case, the rotating shaft M3 may be provided so as to form a right angle with respect to the bottom surface of the tub body 41.

The laundry treatment apparatus 100 having the configuration described above may supply water to the tub 4 via a water supply unit 7, and may discharge water stored in the tub 4 to the outside of the cabinet 2 via a drain unit 8.

The water supply unit 7 may include a first water supply pipe 71 connected to the supply aperture 433 formed in the tub cover 43, a second water supply pipe 73 connected to a water supply source, which is located at the outside of the cabinet 2, and a connection pipe 75 fixed to the drawer cover 35 for connecting the first water supply pipe 71 and the second water supply pipe 73 to each other.

The first water supply pipe 71 may connect the supply aperture 433 and the connection pipe 75 to each other through the second through-hole 353 provided in the drawer cover 35. The first water supply pipe 71 may be a corrugated pipe in order to prevent the first water supply pipe 71 from being separated from the connection pipe 75 when the tub 4 vibrates.

In addition, the second water supply pipe 73 may also be a corrugated pipe in order to prevent the second water supply pipe 73 from being separated from the connection pipe 75 when the drawer 3 is discharged from the cabinet 2. The second water supply pipe 73 may be opened and closed by a water supply valve 77, which is controlled by a controller.

In some cases, the water supply unit 7 may include a single water supply pipe for connecting a water supply source, which is located at the outside of the cabinet 2, to the supply aperture 433 provided in the tub cover 43. In this case, the water supply pipe may be a corrugated pipe.

The drain unit 8 may include a drain pump 81 fixed to the drawer body 31, a first drain pipe 83 for guiding water inside the tub body 41 to the drain pump 81, and a second drain pipe 85 for guiding water discharged from the drain pump 81 to the outside of the cabinet 2. In this case, the second drain pipe 85 may be a corrugated pipe.

In the laundry treatment apparatus 100 having the configuration described above, it may be difficult to discharge the drawer 3 from the cabinet 2 when the door 45 is opened in the state in which the drawer 3 is located inside the cabinet 2. That is, once the door 45 has been opened inside the cabinet 2, the door 45 may interfere with the introduction/discharge opening 21 of the cabinet 2 when the drawer 3 is discharged from the cabinet 2, thereby preventing the discharge of the drawer 3.

In order to solve the problem described above, the laundry treatment apparatus 100 may further include a guide 95 for preventing the door 45 from interfering with the introduction/discharge opening 21 when the drawer 3 is discharged from the cabinet 2.

As illustrated in FIG. 4, the guide 95 may include at least one wheel rotatably provided inside the cabinet 2. In this case, a distance H2 from the upper surface of the drawer 3 to the lowermost end of the wheel 95 may be shorter than a distance H1 from the upper surface of the drawer 3 to the introduction/discharge opening 21.

The wheel 95 may be rotatably fixed to the cabinet 2, or may be fixed to a base 94, which is fixed inside the cabinet 2 so as to be located above the door 45. That is, the wheel 95 may be rotatably fixed to the base 94 via a shaft 953.

In the case where the introduction/discharge opening 21 has the opening 211 and the flange 213, the guide 95 needs to prevent the door 45 from interfering with the flange 213 when the drawer 3 is discharged from the cabinet 2. In this case, the distance H2 from the drawer cover 35 to the lowermost end of the wheel 95 may be shorter than a distance from the drawer cover 35 to the flange 213.

In addition, the distance from the upper surface of the drawer 3 to the lowermost end of the wheel 95 may be set to a length for enabling the coupling of the first fastening portion 471 and the second fastening portion 473 provided in the fixing unit 47. This serves to eliminate a problem in which the door 45 prevents the drawer 3 from being discharged from the cabinet 2 by fixing the door 45 to the tub cover 43 using the guide 95 whenever the drawer 3 is discharged from or inserted into the cabinet 2.

The wheel 95 may include a first wheel and a second wheel, which are spaced apart from each other by a prescribed distance in the direction in which the drawer 3 is discharged (see FIG. 2). The distances from the upper surface of the drawer 3 to the lowermost ends of the respective wheels may be set to the same value, or may be set to different values. In the latter case, the distance from the upper surface of the drawer 3 to the lowermost end of the wheel located close to the introduction/discharge opening 21 may be shorter than the distance from the upper surface of the drawer 3 to the lowermost end of the other wheel.

In some implementations, a first position sensing unit (e.g. a door sensing unit) for determining whether or not the door 45 to open the introduction aperture 431 is opened inside the cabinet 2 may be included.

The first position sensing unit 97 may include a first magnetic-force generator 977 provided in any one of the cabinet 2 and the door 45 for generating magnetic force, and a first magnetic-force sensor 975 provided in the other one of the cabinet 2 and the door 45 for sensing the magnetic force provided by the first magnetic-force generator 977.

FIG. 4 illustrates the case where the first magnetic-force generator 977 is a permanent magnet fixed to the door 45 and the first magnetic-force sensor 975 is fixed to the base 94 so as to sense the magnitude of magnetic force of the permanent magnet by way of example.

When the magnitude of magnetic force of the first magnetic-force generator 977, sensed by the first magnetic-force sensor 975, is below a predetermined reference magnetic force (e.g. a first reference magnetic force), the controller may determine that the drawer 3 is located inside the cabinet 2 and the door 45 to open the introduction aperture 431 is closed.

However, when the magnitude of magnetic force of the first magnetic-force generator 977, sensed by the first magnetic-force sensor 975, is the first reference magnetic force or more, the controller may determine that the door 45 located inside the cabinet 2 to open the introduction aperture 431 is opened.

Upon determining that the door 45 to open the introduction aperture 431, located inside the cabinet 2, is opened, the controller may notify the user that the door 45 inside the cabinet 2 is opened via, for example, the display unit 331*b*.

When the first magnetic-force generator 977 is provided in the door 45, the first magnetic-force generator 977 may vibrate simultaneously with the vibration of the tub 4. When the first magnetic-force generator 977 vibrates, the distance between the first magnetic-force generator 977 and the first magnetic-force sensor 975 varies, thus causing variation in the magnitude of magnetic force measured by the first magnetic-force sensor 975. Therefore, when the first magnetic-force generator 977 is provided in the door 45, the controller may incorrectly determine that the door 45 to open the introduction aperture 431 is opened even though the introduction aperture 431 is closed by the door 45.

To solve the problem described above, the controller may determine whether the magnetic force measured by the first magnetic-force sensor 975 is greater than or equal to the first reference magnetic force, and then may determine that the introduction aperture 431 is opened only when a state in which the measured magnetic force is the first reference magnetic force or more is continued during a predetermined reference time or more.

That is, the display unit 331*b* may display character signals or symbols, generate sound signals, or emit light only when the state in which the magnetic force measured by the first magnetic force sensor 975 is the first reference magnetic force or more is continued during the reference time or more.

The reference time may be set to a longer time than a time required to rotate the drum 5 once. For example, assuming the case where the drum 5 is set to be rotated at 30 RPM, the time required to rotate the drum 5 once is 2 seconds. When the drum 5 vibrates because laundry inside the drum 5 is not evenly distributed, the vibration of the drum 5 may be transmitted to the tub 4 whenever the drum 5 is rotated once. That is, the vibration of the drum 5 may be transmitted to the tub 4 for the period of time required to rotate the drum 5 once (e.g. 2 seconds). Accordingly, when the reference time is set to a longer time than the period during which the vibration of the drum 5 is transmitted to the tub 4 (2 seconds), it is possible to prevent variation in magnetic force attributable to the vibration of the tub 4 or the door 45 from being incorrectly determined to be the opening of the door 45.

The problem of incorrectly determining that the door 45 to open the introduction aperture 431 is opened even though the introduction aperture 431 is closed by the door 45 may be solved using a first position sensing unit 97 illustrated in FIGS. 5 and 6.

In the case of the first position sensing unit 97 illustrated in FIGS. 5 and 6, both the first magnetic-force sensor 975 and the first magnetic-force generator 977 are not provided in the door 45. Thus, even if the tub 4 or the door 45 vibrates, the magnetic force of the first magnetic-force generator 977 measured by the first magnetic-force sensor 975 may be maintained at a relatively constant value.

The first position sensing unit 97 of FIG. 5 may include the first magnetic-force sensor 975 provided in the base 94 for sensing magnetic force, a body 971 configured so as to be rotated toward the first magnetic-force sensor 975 when the door 45 to open the introduction aperture 431 is opened, and the first magnetic-force generator 977 fixed to the body 975.

The body 971 extends from the base 94 toward the door 45, and is rotatably coupled to the base 94 via a body rotating shaft 972. In addition, the first position sensing unit 97 may further include a contact portion 973, which protrudes from the body 971 toward the door 45 so as to come into contact with the door 45 when the door 45 to the introduction aperture 431 is opened.

When the door 45 to open the introduction aperture 431 is opened in the state in which the drawer 3 is inserted into the cabinet 2, the body 971 may be moved toward the first magnetic-force sensor 975 by the door 45, and therefore the magnetic force of the first magnetic-force generator 977 sensed by the first magnetic-force sensor 975 may be increased.

Accordingly, when the magnitude of magnetic force of the first magnetic-force generator 977, sensed by the first magnetic-force sensor 975, is the first reference magnetic-force or more, the controller may determine that the door 45 to open the introduction aperture 431 is opened. Upon determining that the door 45 to open the introduction aperture 431 is opened, the controller may notify the user that the door 45 is opened via the display unit 331*b*. Through the process described above, the user may be notified that the door to open the introduction aperture 431 is opened.

Although the possibility of the first position sensing unit 97 of FIG. 5 incorrectly determining that the door 45 to open the introduction aperture 431 is opened is low even if the tub 4 or the door 45 vibrates the because both the first magnetic-force sensor 975 and the first magnetic-force generator 977 are fixed to the base 94, the first position sensing unit 97 may have a risk of incorrectly determining that the door 45 to open the introduction aperture 431 is opened when the cabinet 2 vibrates.

To solve the problem described above, whether or not the magnetic force measured by the first magnetic-force sensor 975 is equal to or greater than the first reference magnetic force may be determined, and only when the state in which the measured magnetic force is the first reference magnetic force or more is continued during the reference time or more, the controller may determine that the introduction aperture 431 is opened by the door 45.

That is, the display unit 331*b* may display character signals or symbols, may generate sound signals, or may emit light only when the state in which the magnetic force measured by the first magnetic-force sensor 975 is equal to or greater than the first reference magnetic force is continued during the reference time or more. The reference time may be set to a longer time than a period during which vibration of the drum 5 is transmitted to the tub 4.

The first position sensing unit 97 of FIG. 5 disadvantageously has no function of determining whether or not the first magnetic-force generator 977 is separated from the body 971 even though the first magnetic-force generator 977 is separated from the body 971 due to vibration of the laundry treatment apparatus 100 or other reasons.

The first position sensing unit 97 of FIG. 6 may be devised to solve the above-described problem of the first position sensing unit 97 of FIG. 5. The first position sensing unit 97 may include the first magnetic-force sensor 975 fixed to the base 94 located above the door 45, the body 971 configured so as to be rotated away from the first magnetic-force sensor 975 when the door 45 to open the introduction aperture 431 is opened, and the first magnetic-force generator 977 fixed to the body 971.

The body 971 extends from the base 94 toward the first magnetic-force sensor 975. The body 971 may be rotatably fixed to the base 94 via a body rotating shaft. When the body 971 is formed of an elastic material, such as rubber, the body 971 may be fixed to the base 94 via a body fastening portion 976.

The body 971 may be provided with the body contact portion 973, which protrudes toward the door 45 so as to come into contact with the door 45 when the door 45 to open the introduction aperture 431 is opened.

In order to prevent the body 971 from being rotated toward the drawer 3 or the door 45, the base 94 may further be provided with a body support portion 941 for preventing the body 971 from being rotated toward the door 45. The body support portion 941 may be provided so as to directly support the body 971, and may be provided so as to support a body protruding portion 974 provided on the body 971.

In some implementations, the magnetic force of the first magnetic-force generator 977 measured by the first magnetic-force sensor 975 becomes the maximum when the door 45 to open the introduction aperture 431 is closed, and becomes the minimum when the door 45 to open the introduction aperture 431 is opened. Accordingly, the controller may determine that the door 45 to open the introduction aperture 431 is opened when the magnitude of magnetic force sensed by the first magnetic-force sensor 975 is below the first reference magnetic force.

Upon determining that the door 45 to open the introduction aperture 431 is opened, the controller may notify the user that the door 45 is opened via the display unit 331*b*. Therefore, the user may be notified of whether or not the current state is the state in which the door 45 to open the introduction aperture 431 is opened.

In some implementations, the controller may also determine whether or not the magnetic force measured by the first magnetic-force sensor 975 is below the first reference magnetic force, and may determine that the introduction aperture 431 is opened only when the state in which the measured magnetic force is below the first reference magnetic force is continued during the reference time or more.

In this case, the display unit 331*b* may display character signals or symbols, may generate sound signals, or may emit light only when the state in which the measured magnetic force is below the first reference magnetic force is continued during the reference time or more. The reference time may be set to a time, which is longer than the period during which vibration of the drum 5 is transmitted to the tub 4.

When the first magnetic-force sensor 975 fails to sense the magnetic force of the first magnetic-force generator 977 in the state in which the drawer 3 is discharged from the cabinet 2, the controller may determine that the first magnetic-force generator 977 is separated from the body 971, and may notify the user of the result of determination.

In addition to the first position sensing unit 97 described above, the laundry treatment apparatus 100 may further include a second position sensing unit 99 (e.g. a drawer sensing unit) for determining whether or not the drawer 3 is inserted to the inside of the cabinet 2. The second position sensing unit 99 may serve to determine whether or not the drawer 3 is located at a predetermined reference position. In one example, the reference position may be a position at which the introduction/discharge opening 21 is closed by the drawer panel 33.

The second position sensing unit 99 may include a second magnetic-force generator 993 provided in any one of the drawer 3 and the cabinet 2 for generating magnetic-force, and a second magnetic-force sensor 991 provided in the other one of the drawer 3 and the cabinet 2 for sensing the magnitude of magnetic force provided by the second magnetic-force generator 993.

The second magnetic-force sensor 991 and the second magnetic-force generator 993 may be provided at positions at which whether or not the introduction/discharge opening 21 is closed by the drawer panel 33 may be determined. FIGS. 4 to 6 illustrate the case where the second magnetic-force generator 993 is a permanent magnet fixed to the front side of the drawer cover 35 and the second magnetic-force sensor 991 is fixed to the base 94 for sensing the magnitude of magnetic force of the permanent magnet.

When the drawer 3 is not completely inserted into the cabinet 2, but is operated, the drawer 3 may be discharged from the cabinet 2 by vibration generated during rotation of the drum 5.

To solve the problem described above, the controller may notify the user that the magnitude of magnetic force sensed by the second magnetic-force sensing unit 99 is below a predetermined reference magnetic-force (e.g. a second reference magnetic force) via the display unit 331*b* (using character signals, symbols, sound signals, and light emission).

As is apparent from the above description, the laundry treatment apparatus may notify a user that a door to open an introduction aperture is opened in the state in which a drawer is inserted into a cabinet.

In addition, the laundry treatment apparatus may allow a drawer to be discharged from a cabinet even if a door to open an introduction aperture is opened in the state in which the drawer is inserted into the cabinet.

In addition, the laundry treatment apparatus may determine whether or not a drawer is inserted into a cabinet and may notify a user of the result of the determination.

In addition, the laundry treatment apparatus may rapidly sense that a door is opened when a drawer is inserted into a cabinet.

In addition, the laundry treatment apparatus may determine the occurrence of abnormalities in constituent elements for determining whether or not a door is opened.

In addition, the laundry treatment apparatus may eliminate or reduce the possibility of incorrectly determining a door to be opened even through the door is not opened.

What is claimed is:

1. A laundry treatment apparatus comprising:

a cabinet having an opening;

a drawer configured to withdraw from the cabinet through the opening;

a through-hole formed in an upper surface of the drawer;

a tub that is located inside the drawer and that defines a space that is configured to receive water, the tub comprising a tub cover located below the through-hole of the drawer;

an introduction aperture defined in the tub cover, the introduction aperture being located under the through-hole;

a drum rotatably provided inside the tub for receiving laundry supplied to the introduction aperture;

a door that is configured to open and close the introduction aperture; and a door sensing unit that is configured to sense whether the door is opened in a state in which the drawer is inserted into the cabinet, wherein the door sensing unit comprises a sensor that is located in the cabinet at a position above the tub cover and that is configured to sense opening of the door in the state in which the drawer is inserted into the cabinet.

2. The laundry treatment apparatus according to claim 1, wherein the door is configured to detachably couple to the tub cover.

3. The laundry treatment apparatus according to claim 1, wherein the sensor is configured to sense opening of the door based on the door contacting the cabinet.

4. The laundry treatment apparatus according to claim 1, wherein the door sensing unit further includes:

a generator that is located at the cabinet and that is configured to cause an excitation of the sensor based on the door contacting the cabinet.

5. The laundry treatment apparatus according to claim 4, wherein the door comprises:

a frame rotatably coupled to the upper surface of the drawer or to the tub cover; and a handle provided in front of the frame and configured to detachably couple the frame to the upper surface of the drawer or to the tub cover, wherein the generator is provided at the handle or at the frame, and wherein the sensor is provided at the cabinet at a location above the generator.

6. The laundry treatment apparatus according to claim 4, further comprising a base coupled to an upper surface of the cabinet and provided above the door, wherein the base is located between the opening and a rotational axis of the drum, wherein the door sensing unit further comprises a body rotatably coupled to the base, wherein the generator is provided at the body, and wherein the sensor is provided at the base to sense a magnitude of the excitation of the sensor caused by the generator.

7. The laundry treatment apparatus according to claim 6, wherein the door comprises:

a frame rotatably coupled to the upper surface of the drawer or the tub cover; and a handle provided in front of the frame and configured to detachably couple the frame to the upper surface of the drawer or to the tub cover, wherein the handle or a front of the frame is provided to rotate the body based on the door opening the introduction aperture.

8. The laundry treatment apparatus according to claim 7, wherein the body further comprises a body contact portion that is located on the body and that is configured to contact the door based on the door opening the introduction aperture.

9. The laundry treatment apparatus according to claim 8, wherein the base further comprises a body support portion that is located at the base and that is configured to restrict the body from rotating toward the door.

10. The laundry treatment apparatus according to claim 9, wherein the body further comprises a projection extending from a head of the body and being seated on the body support portion.

11. The laundry treatment apparatus according to claim 7, wherein the base is configured to accommodate the body in the base, wherein the generator is provided inside of the body, wherein the generator is configured, based on rotation of the body, to move away from the sensor based on the door opening the introduction aperture.

12. The laundry treatment apparatus according to claim 11, further comprising a notification unit that is configured to notify a user that the door is opened based on the excitation sensed by the sensor.

13. The laundry treatment apparatus according to claim 6, wherein the body includes a body rotation shaft that is rotatably coupled to the base, and wherein the sensor is provided in the base, and wherein the generator is coupled to the body rotation shaft and configured to approach or move away from the sensor based on rotation of the body relative to the base.

14. The laundry treatment apparatus according to claim 13, wherein the body is exposed from the base in which the generator is provided toward the door, and wherein the generator is configured to, based on rotation of the body, approach toward the sensor based on the door opening the introduction aperture.

15. A laundry treatment apparatus comprising:

a cabinet having an opening;

a drawer configured to withdraw from the cabinet through the opening;

a through-hole formed in an upper surface of the drawer;

a tub that is located inside the drawer and that defines a space that is configured to receive water, the tub comprising a tub cover located below the through-hole of the drawer;

an introduction aperture defined in the tub cover, the introduction aperture being located under the through-hole;

a drum rotatably provided inside the tub for receiving laundry supplied to the introduction aperture;

a door that is configured to open and close the introduction aperture, the door being configured to rotatably couple to the tub cover that defines the introduction aperture; and a door sensing unit that is configured to sense whether the door is opened in a state in which the drawer is inserted into the cabinet, wherein the door sensing unit includes:

a base that is located inside the cabinet and that is positioned above the door;

a sensor that is located in the base;

a body that is located in the base and that is configured to be rotated toward or away from the sensor based on the door being opened; and a generator that is coupled to the body and that is configured to cause an excitation of the sensor.

16. The laundry treatment apparatus according to claim 15, wherein the generator is provided to generate a magnetic force, and wherein the sensor is configured to sense the magnetic force.

* * * * *